US005186213A

United States Patent [19]

Urata et al.

[11] Patent Number: 5,186,213

[45] Date of Patent: Feb. 16, 1993

[54] HYDRAULIC SERVO-VALVE

[75] Inventors: Eizo Urata, 18-18, Ogawa 2-chome, Machida-shi, Tokyo, Japan; Shinpei Miyakawa, Kanagawa, Japan

[73] Assignees: Ebara Research Co. Ltd., Kanagawa; Eizo Urata, Tokyo, both of Japan

[21] Appl. No.: 476,443

[22] PCT Filed: Dec. 2, 1988

[86] PCT No.: PCT/JP88/01221

§ 371 Date: Jun. 10, 1991

§ 102(e) Date: Jun. 10, 1991

[87] PCT Pub. No.: WO89/05407

PCT Pub. Date: Jun. 15, 1989

[30] Foreign Application Priority Data

Dec. 2, 1987 [JP] Japan ..... 62-303278
Dec. 2, 1987 [JP] Japan ..... 62-303279
Dec. 2, 1987 [JP] Japan ..... 62-303280

[51] Int. Cl.[5] ..... F15B 13/043

[52] U.S. Cl. ..... 137/625.61; 137/596.15; 137/596.16; 137/625.62

[58] Field of Search ..... 137/596.15, 596.16, 137/625.61, 625.62

[56] References Cited

U.S. PATENT DOCUMENTS 2,832,318 4/1958 Paine .
2,977,985 4/1961 Ericson .
3,012,575 12/1961 Woody .
3,135,294 6/1964 Huber ..... 137/625.61
3,370,613 2/1968 Weaver .
3,455,334 7/1969 Martinson .
3,912,222 10/1975 Hayner .

FOREIGN PATENT DOCUMENTS 2156626 6/1973 France .
2292913 6/1976 France .
1058400 2/1967 United Kingdom .

OTHER PUBLICATIONS

*Journal Mechanical Engineering Science*, vol. 11, No. 2 (Jun. 1969), pp. 168–174.
*Japan Mechanical Association Paper*, vol. 43 No. 375 (Nov. 1977), pp. 4195–4207.
*Japan Mechanical Association Paper*, vol. 43 No. 373 (Sep. 1977), pp. 3347–3356.
*Japan Mechanical Association Magazine*, vol. 89, No. 817 (Dec. 1986), pp. 1387–1391.

*Primary Examiner*—Gerald A. Michalsky
*Attorney, Agent, or Firm*—Nikaido, Marmelstein, Murray & Oram

[57] ABSTRACT

An improved hydraulic servo-valve including a spool (10, 10R, 10L) adapted to slidably move in a valve body (1) to change the direction of flow of a working liquid and vary a flow rate of the working liquid, nozzle back-pressure chambers (18, 18R, 18L) to which a pilot pressure is applied for displacing the spool (10, 10R, 10L), and a flapper mechanism comprising nozzles (19, 19R, 19L) and flappers (20, 20R, 20L) is disclosed. Static pressure bearings (14R, 14L, 141R, 141L, 142R, 142L) are formed at opposite ends of the spool (10, 10R, 10L). In addition, the hydraulic servo-valve is formed with passages extend from a pump port (P) to the nozzle back-pressure chambers (18, 18R, 18L) via the static pressure bearings (14R, 14L, 141R, 141L, 142R, 142L).

7 Claims, 8 Drawing Sheets

HYDRAULIC SERVO-VALVE

TECHNICAL FIELD

The present invention relates to a hydraulic servo-valve preferably employable for a case where water is used as a working liquid.

BACKGROUND ART

An electrical-hydraulical servo-valve (hereinafter referred to as "a hydraulic servo-valve") has been widely heretofore used, e.g., for numerical control of a machine tool or remote control, by converting a weak intensity electrical input signal into hydraulic pressure. With the converted hydraulic pressure, the hydraulic servo-valve changes the direction of flow of a working liquid and moreover changes a flow rate of the working liquid. A few examples of the conventional hydraulic servo-valves will be described below with reference to FIGS. 1 to 3.

Referring to FIGS. 1 and 2, the hydraulic servo-valve is fed with pressurized hydraulic oil via a pump port P. When e.g. a coil 22R of a torque motor 21 is magnetized in response to an electrical input signal, a movable shaft 24 is displaced in the rightward direction, whereby the lower end 20Ra of a flapper 20R is displaced in the leftward direction. Thus, pressure in a nozzle back-pressure chamber 18R is increased and moreover pressure in a pilot chamber 13R is also increased. As a result, a spool 10 is displaced in the leftward direction so that the hydraulic oil is introduced in the interior of a hydraulic cylinder (not shown) from the pump port P via a cylinder port C1. On the other hand, the hydraulic oil returning from the hydraulic cylinder returns to a tank (not shown) from a cylinder port C2 via a passage 5 and a tank port R. In addition, the hydraulic oil flowing from the gap between the nozzle 19R and the flapper 20R returns to the tank from the tank port R via a passage 6.

FIG. 3 is a view which schematically illustrates another conventional hydraulic servo-valve. This hydraulic servo-valve is provided with an opposing pair of nozzles on both sides of a flapper. Referring to FIG. 3, as the hydraulic servo-valve is fed with hydraulic oil via a pump port P, the hydraulic oil flows through passages 26L and 26R in a valve body 1 so that it is introduced into nozzle back-pressure chambers 18L and 18R via orifices 27L and 27R for controlling back-pressure. The hydraulic oil discharged from the gaps between nozzles 19L and 19R and a flapper 20 returns to a tank (not shown) via passages 6L and 6R and tank ports R1 and R2. When the flapper 20 is displaced, e.g., in the leftward direction in response to an electrical signal inputted into a torque motor 21, pressure in the nozzle back-pressure chamber 18L is increased and moreover pressure in a pilot chamber 13L is also increased. On the other hand, pressure in a nozzle back-pressure chamber 18R is reduced and moreover pressure in a pilot chamber 13R is reduced. Thus, a spool 10 slidably received in a sleeve 2 is displaced in a rightward direction against the resilient force of a spring 28R. As a result, the hydraulic oil is introduced into the interior of a cylinder (not shown) from the pump port P via a cylinder port C1. On the other hand, the hydraulic oil returning from the hydraulic cylinder returns to a tank (not shown) from a cylinder port C2 via tank port R2.

Since the hydraulic oil serving as a working liquid is very inflammable, care must be taken during handling of the hydraulic oil. Waste hydraulic oil may cause environmental contamination.

In the past, water was used as a working liquid for driving or controlling a hydraulic machine. However, in a case where water serves as a working liquid, since water has a low viscosity, there arise problems that a large quantity of water leaks through a clearance S between a spool and a sleeve, resulting in a low rate of efficiency, slidable portions are subject to wear due to friction and a hydraulic machine fabricated using a metallic material (particularly, ferrous material) is liable to rust, if it is left unused.

In recent years, considerable advances in the production of new raw materials have been made, e.g., plastics. Accordingly, one of the aforementioned problems, i.e., rust, appearing in the case where water is employed as a working liquid can be satisfactorily solved by fabricating portions coming into contact with a working liquid in a hydraulic machine from a new raw material. However, the problem concerning wear due to the low visocity of the working liquid (water) is still left unsolved. In addition, it is difficult to machine slidable portions with a high decree of accuracy for the purpose of minimizing leakage of the working liquid.

With the conventional hydraulic servo-valve as shown in FIGS. 1 and 2, the stroke of the spool 10 cannot be made large, because the hydraulic servo-valve has a narrow gap between the nozzle 19R and the flapper 20R. For this reason, the hydraulic servo-valve cannot be designed to have a high flow rate. Another problem is that the flapper mechanism has low responsiveness due to a large amount of working liquid leakage through the clearance S, S1, between the spool and the sleeve.

The present invention has been made with the foregoing problems in mind and its object resides in providing a hydraulic servo-valve wherein water can be used as a working liquid, problems concerning wear, rusting and leakage have satisfactorily been solved and responsiveness of the flapper mechanism has been improved.

DISCLOSURE OF THE INVENTION

To accomplish the above object, the present invention provides a hydraulic servo-valve including a spool adapted to slidably move in a valve body to change the direction of flow of a working liquid and vary a flow rate of the working liquid, nozzles back-pressure chambers to which a pilot pressure is applied to displace the spool and a flapper mechanism comprising nozzles and flappers, wherein the spool is formed with static pressure bearings at opposite ends thereof so as to form passages for the working fluid to flow therethrough, each of the flow passages extending from a pump port to the nozzle back-pressure chambers via the static pressure bearings.

With the hydraulic servo-valve of the present invention, the spool can be supported in a valve body by the static pressure bearings at opposite ends of the spool without contact of the spool with the valve body this preventing wear of the spool and the valve body. Additionally, slidable portions between the spool and the valve body may be machined with a low degree of machining accuracy. Thus, the hydraulic servo-valve can be fabricated by using a new raw material (e.g., plastics) which has been heretofore precisely machined only with a great deal of difficulty. As a result, no rusting occurs, even when water is used as a working liquid.

Further, according to the present invention, the working liquid coming from a pump port can be positively utilized in the form of a static pressure in each of static pressure bearings. In addition, after the working liquid is utilized as a supply source for static pressure in that way, it can be utilized for actuating a flapper mechanism by introducing the working liquid into a nozzle back-pressure chamber without wasteful discharge of the working liquid into a tank. Further, when the spool is separated from the flapper mechanism, i.e., when a nozzle is attached to a valve body, the operative range set for positional displacement of the spool can be enlarged in contrast with a case in which the nozzle is attached to the spool. Specifically, in a case where the nozzle is attached to the spool, the operative range set for positional displacement of the spool is limited only to a distance between the nozzle and the flapper. In contrast, when the nozzle is attached to the valve body, the hydraulic servo-valve is not subject to such a limitation as mentioned above. When the spool is displaced, the direction of flowing of the working liquid from the pump port to a cylinder is changed. According to the present invention, since the operative range set for positional displacement of the spool is enlarged in the above-described manner, a flow rate of the working liquid flowing from the pump port toward the cylinder can be increased.

According to the present invention, since water which is not inflammable is used as a working liquid, it can be handled easily. Waste working liquid does not lead to environmental contamination or other damage.

To carry out the present invention, it is preferable that a stainless material, e.g., a plastic is used for components which come into contact with the working liquid. Thus, an occurrence of rusting in the presence of water can be reliably prevented.

BEST MODE FOR CARRYING OUT THE INVENTION

Now, the present invention will be described in detail hereinafter with reference to serveral preferred embodiments thereof.

Figure 4:
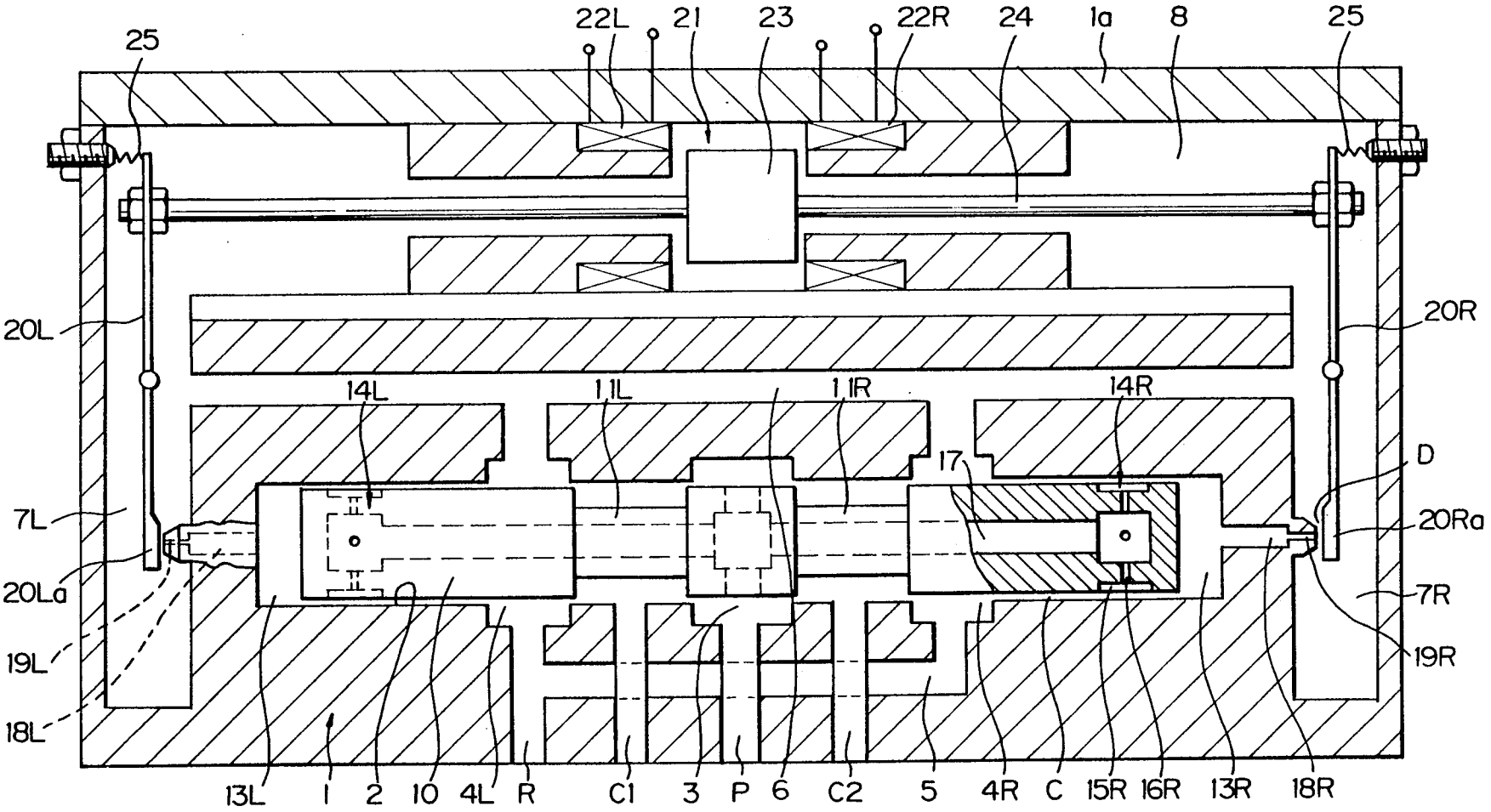
FIGS. 4 to 8 respectively are a sectional view of an embodiment of a hydraulic servo-valve in accordance with the present invention.

FIG. 4 is a first embodiment of the present invention. The hydraulic servo-valve of the present invention includes a valve body 1 in which a sleeve 2 is formed and a spool 10 is slidably received in the sleeve 2. The sleeve 2 and the spool 10 are made of stainless material, e.g., a plastic or like material. A sleeve port 3 is formed in the sleeve 2, and sleeve ports 4L and 4R are formed on the both sides of the sleeve ports 3. The sleeve port 3 is communicated with a pump port P, the sleeve port 4L is communicated with a tank port R leading to a water tank (not shown), and the sleeve port 4R is likewise communicated with the tank port R via a passage 5. A cylinder port C1 is communicated with an intermediate location between the sleeve port 3 and the sleeve port 4L, while a cylinder port C2 is communicated with an intermediate location between the sleeve port 3 and the sleeve port 4R. It should be noted that the tank port R, the passage 5, the pump port P, the cylinder port C1 and the cylinder port C2 are shown in a common plane on the drawing for the purpose of simplification of illustration but these ports and passage are practically arranged such that they do not overlap each other (this is the case in another embodiment which will be described later). The sleeve ports 4L and 4R are communicated with chambers 7L and 7R which are formed on the both sides of the sleeve 2 via a passage 6. The chambers 7L and 7R are communicated with a chamber 8 which is defined by a cover 1*a* placed on the upper surface of the valve body 1. Additionally, the chambers 7L and 7R are communicated with the sleeve 2 via nozzles 19L and 19R and nozzle back-pressure chambers 18L and 18R which are formed in alignment with a center axis of the sleeve 2.

An annular clearance C is formed between the spool 10 and the sleeve 2 and smaller diameter portions 11L and 11R are formed in the intermediate part of the spool 2. Namely, the smaller diameter portion 11L is formed between the sleeve port 3 and the sleeve port 4L and has a longitudinal length appreciably shorter than a distance between the sleeve port 3 and the sleeve port 4L, while the smaller diameter portion 11R is formed between the sleeve port 3 and the sleeve port 4R and has a longitudinal length appreciably shorter than the distance between the sleeve port 3 and the sleeve port 4R. A pilot chamber 13L is formed between the left-hand end of the sleeve 2 and the left-hand end surface of the spool 10, while a pilot chamber 13R is formed between the right-hand end of the sleeve 2 and the right-hand end surface of the spool 10. Static pressure bearings 14L and 14R are formed at opposite ends of the spool 10. Here, description will be made below only as to the static pressure bearing 14R. Specifically, the static pressure bearing 14R comprises an annular pocket 15R and a plurality of orifices (four orifices) 16R which are arranged in an equally spaced relationship in the circumferential direction. The orifices 16R are communicated with the sleeve port 3 via a passage 17. Thus, the pump port P is communicated with the nozzle back-pressure chambers 18L and 18R via the passage 17, the static pressure bearings 14L and 14R, the clearance C and the pilot chambers 13L and 13R.

Lower ends 20R*a* and 20R*b* of flappers 20R and 20L are arranged opposite to each other, while defining a gap D between the nozzle 19R and the flapper 20R as well as between the nozzle 19L and the flapper 20L. The flappers 20R and 20L are turnably supported to the valve body 1.

A torque motor typically represented by reference numeral 21 is received in the middle part of the chamber 8. the torque motor 21 includes coils 22L and 22R, an armature 23 and a movable shaft 24 as essential components, and opposite ends of the movable shaft 24 are fastened to the upper ends of the flappers 20L and 20R. Return springs 25, 25 are resiliently bridged between the uppermost ends of the flappers 20L and 20R and the valve body 1.

Next, operation of the hydraulic servo-valve shown in FIG. 4 will be described below. Pressurized hydraulic liquid (water) is introduced in the interior of the hydraulic servo-valve via the pump port P and flows through the passage 17, e.g., in the rightward direction to reach the static pressure bearing 14R. Then, the hydraulic liquid leaks into the clearance C from the static pressure bearing 14R via the orifices 16R and the pocket 15R to thereby support the spool 10 without contact of the spool 10 with the inner wall surface of the sleeve 2. The hydraulic liquid is divided into two parts at the pocket 15R, one of them flows in the leftward direction and the other flows in the rightward direction. A quantity of divided hydraulic liquid is determined depending on the size and length of the clearance C and a volume of the pocket 15R. As long as the hydraulic liquid leaks through the clearance C, the spool 10 is supported without contact of the spool 10 with the inner wall surface of the sleeve 2, whereby no wear occurs between the sleeve 2 and the spool 10. Consequently, the sleeve 2 and the spool 10 made of plastic material may be machined with a low degree of accuracy. In addition, since the sleeve 2 and the spool 10 are made of a plastic material, there is no danger that deterioration in the form of rusting will occur.

After completion of the flow of hydraulic liquid through the clearance C in the axial direction rightwardly, the hydraulic liquid further flows through the pilot chamber 13R and the nozzle back-pressure chamber 18R to reach the nozzle 19R from which the hydraulic liquid flows out through the gap D. Then, the hydraulic liquid returns to the tank via the chamber 7R, the passage 6, the sleeve port 4R, the passage 5 and the tank port R.

When, e.g., the coil 22R of the torque motor 21 is magnetized in response to the electrical signal input into the torque motor 21 during operation of the hydraulic servo-valve, the movable shaft 24 is displaced in the rightward direction thereby to displace the lower end 20R*a* of the flapper 20R in the leftward direction, whereby back-pressure in the nozzle back-pressure chamber 18R is increased. Thus, pressure in the pilot chamber 13R is increased so that the spool 10 is displaced in the leftward direction. As a result, the hydraulic liquid is introduced in the interior of a cylinder (not shown) via the sleeve port 3 and the cylinder port C2. On the other hand, the hydraulic liquid returning from the cylinder is delivered back to the tank from the cylinder port C1 via the sleeve port 4L and the tank port R. In a case where the coil 22L is magnetized, the hydraulic servo-valve operates in the reverse manner to the above-described case.

Figure 5:
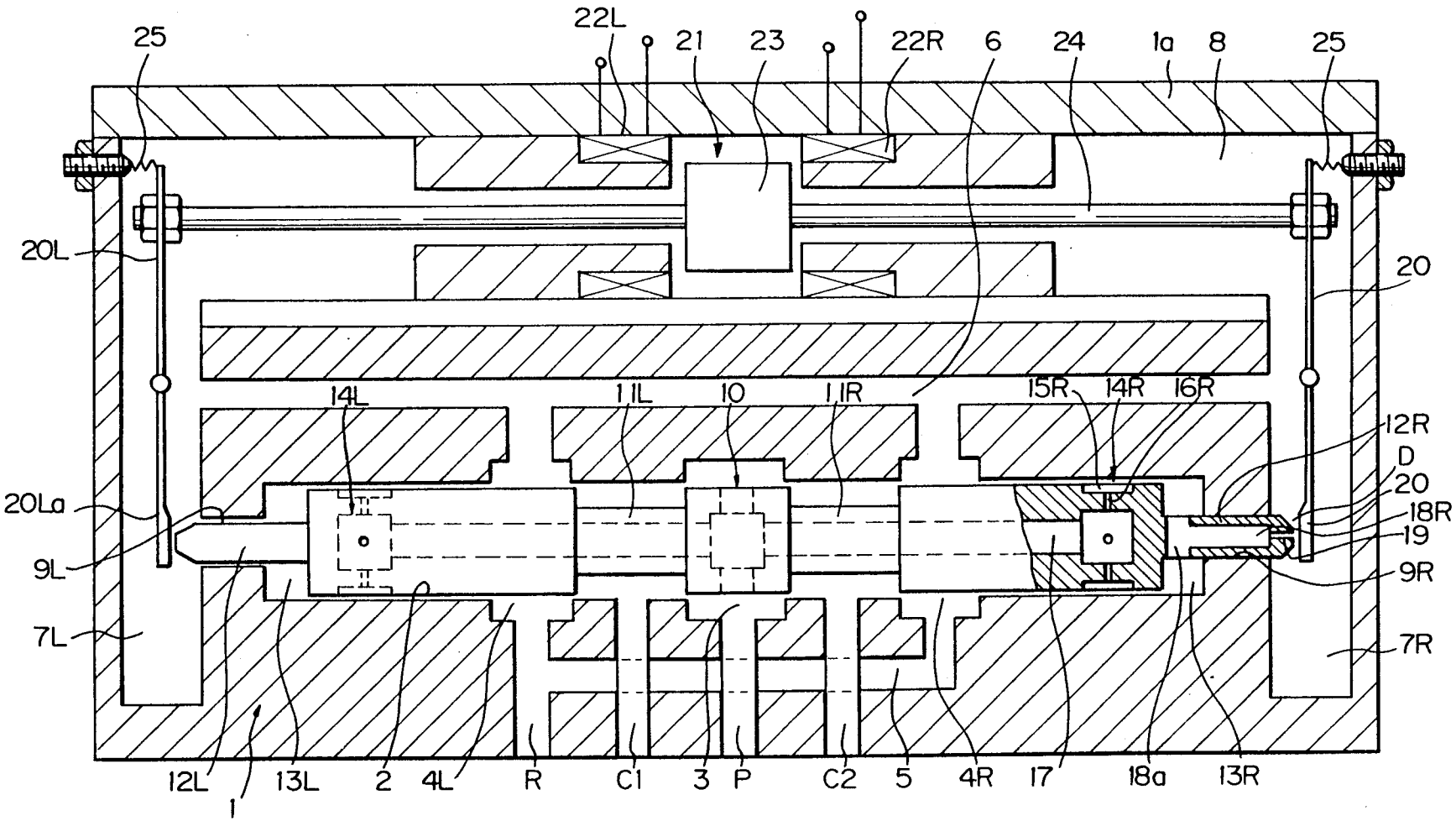

In the embodiment shown in FIG. 5, nozzles are formed in a spool. The spool 10 is provided with smaller diameter portions 12L and 12R slidably received in holes 9L and 9R which are formed in the sleeve 2 at opposite ends thereof. By this construction, a pilot chamber 13L is defined by the sleeve 2, the end surface of the spool 10 and the smaller diameter portion 12L, while a pilot chamber 13R is likewise defined by the sleeve 2, the end surface of the spool 10 and the smaller diameter portion 12R. The smaller diameter portion 12R includes a through hole 18*a* extending at a right angle relative to a center axis of the spool 10, a nozzle back-pressure chamber 18R communicated with the hole 18*a* and a nozzle 19R communicated with the chamber 18R. Thus, a pump port P is communicated with the back-pressure chamber 18R via a passage 17, a static pressure bearing 14R, an annular clearance C and the hole 18*a*. Further, the pump port P is communicated with the chamber 8 via the nozzle 19R.

Figure 6:
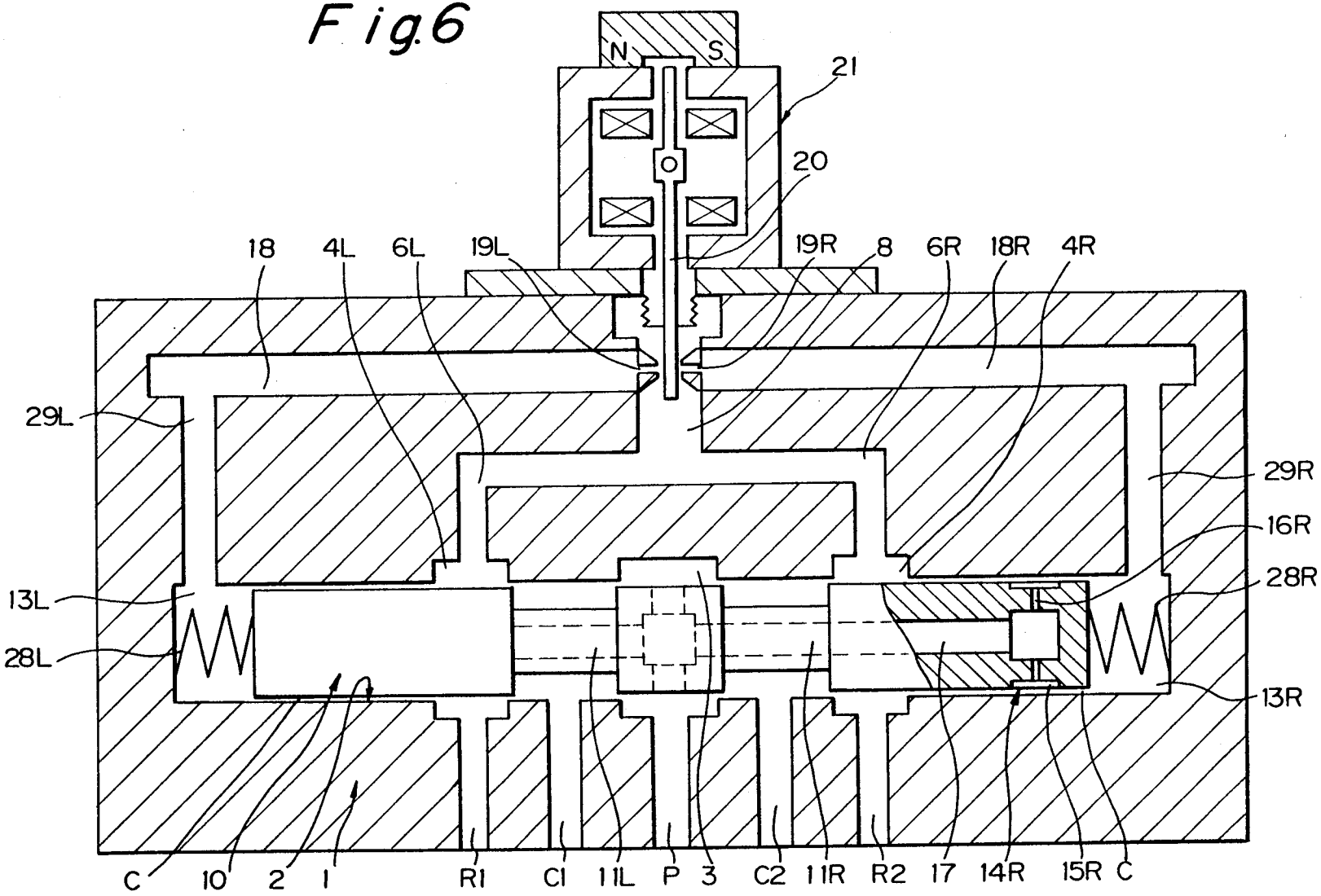

In the embodiment shown in FIG. 6, the hydraulic servo-valve includes a single flapper 20 and an opposing pair of nozzles 19L and 19R which are located on both sides of the flapper 20. A valve body 1 is made of a stainless material, e.g., a plastic material or the like, and a torque motor 21 is immovably mounted on the upper surface of the valve body 1. The flapper 20 protrudes downward in the interior of a central chamber 8 of the valve body 1.

A pair of nozzles 19L and 19R and a pair of nozzle back-pressure chambers 18L and 18R are arranged on both sides of the flapper 20 in alignment with each other in the horizontal direction, while a slight gap is kept between the flapper 20 and each of the nozzle 19L and 19R.

On the other hand, a sleeve 2 is formed in the valve body 1 in parallel with the axis line of the nozzle 19L and 19R and a spool 10 is slidably received in the sleeve 2. A clearance C is provided between the inner wall of the sleeve 2 and the outer surface of the spool 10. Springs 28L, 28R are received in pilot chambers 13L, 13R which are defined by the end surfaces of the spool 10 and the inner walls of the sleeve 2. The pilot chambers 13L and 13R are communicated with the nozzle back-pressure chambers 18L and 18R via passages 29L and 29R.

The spool 10 is formed with static pressure bearings 14L (not shown) and 14R at opposite ends thereof. It should be noted that for the purpose of simplification in FIG. 6, only the right-hand static pressure bearing 4 is shown. The static pressure bearing 14R includes a pocket 15R and orifices 16R and is communicated with the sleeve port 3 via the passage 17.

Next, operation of the third embodiment will be described below.

Figure 1:
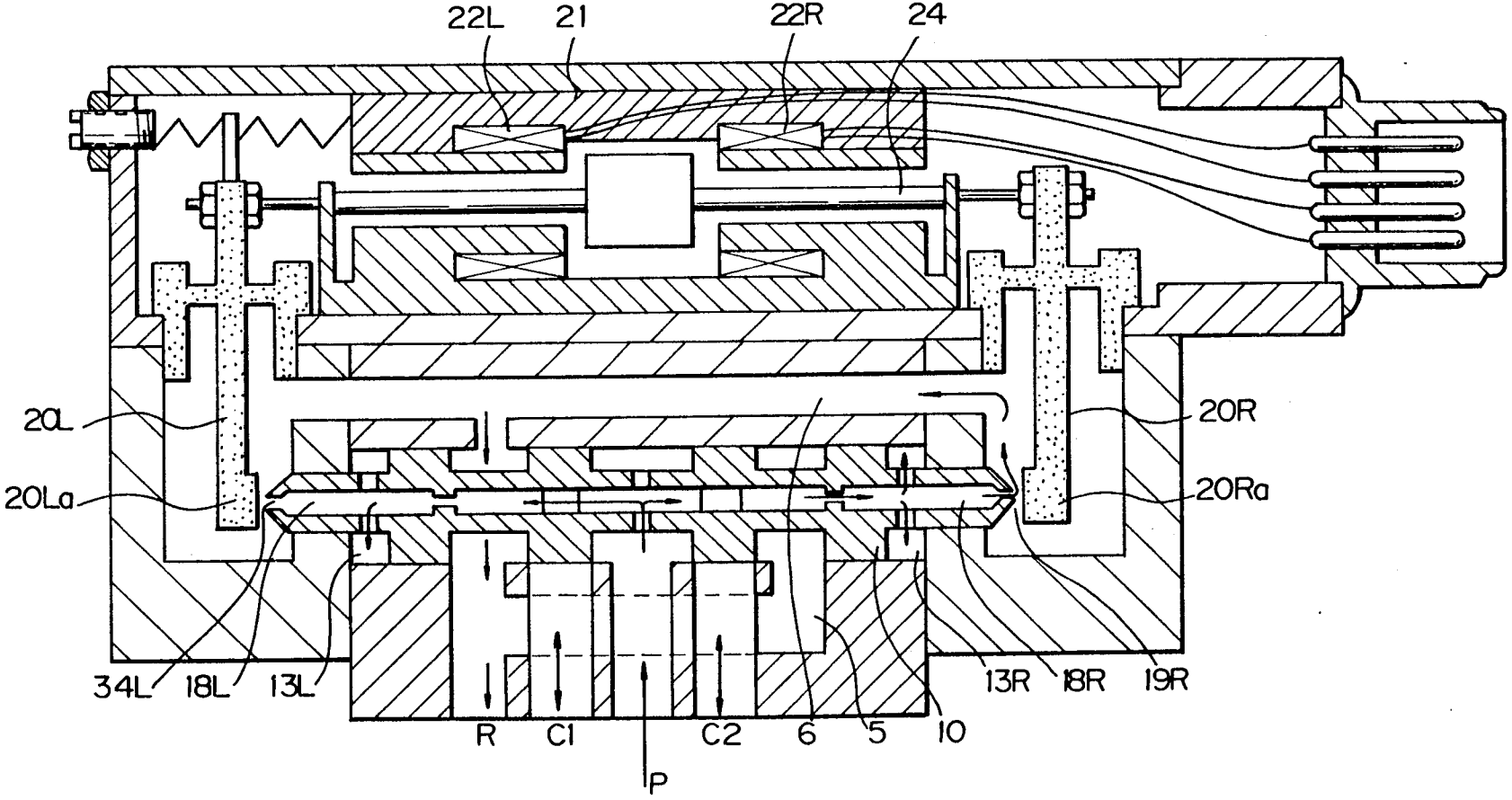
Fig. 1 PRIOR ART
FIG. 1 is a sectional view which schematically illustrates by way of example a conventional hydraulic servo-valve.
Figure 2:
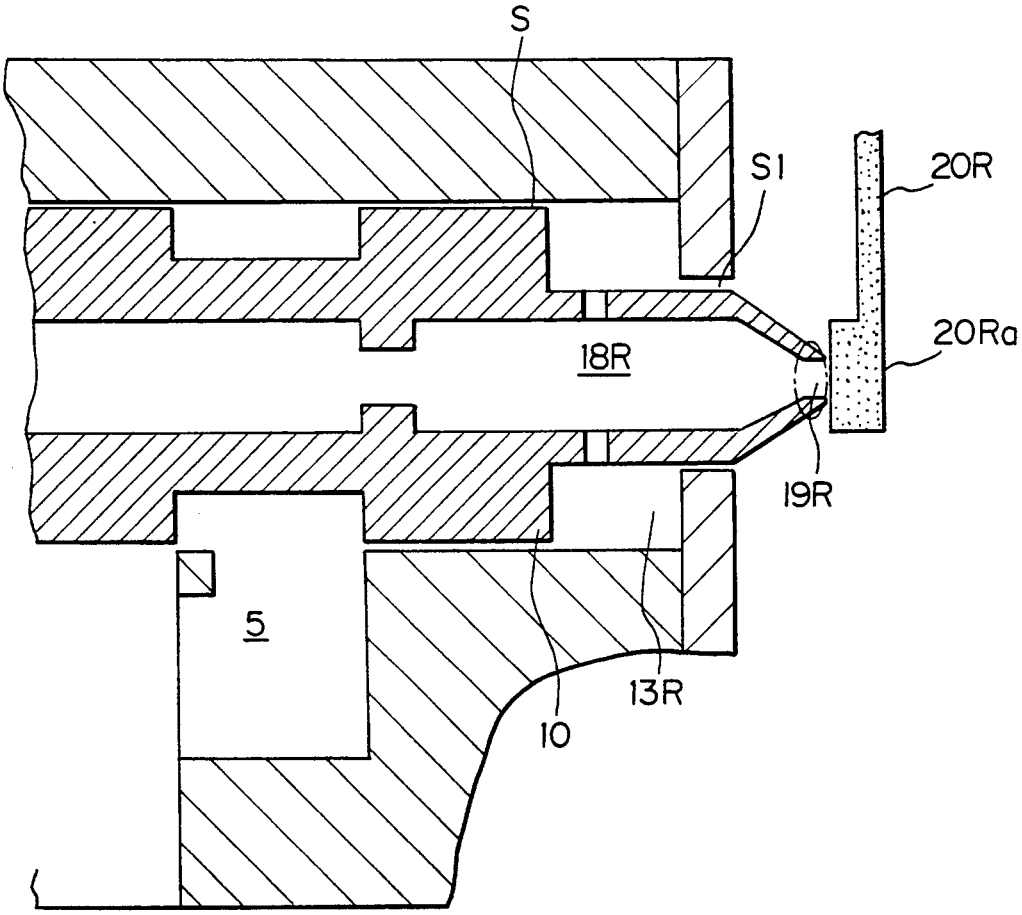
Fig. 2 PRIOR ART
FIG. 2 is a fragmentary enlarged sectional view of the conventional hydraulic servo-valve in FIG. 1.
Figure 3:
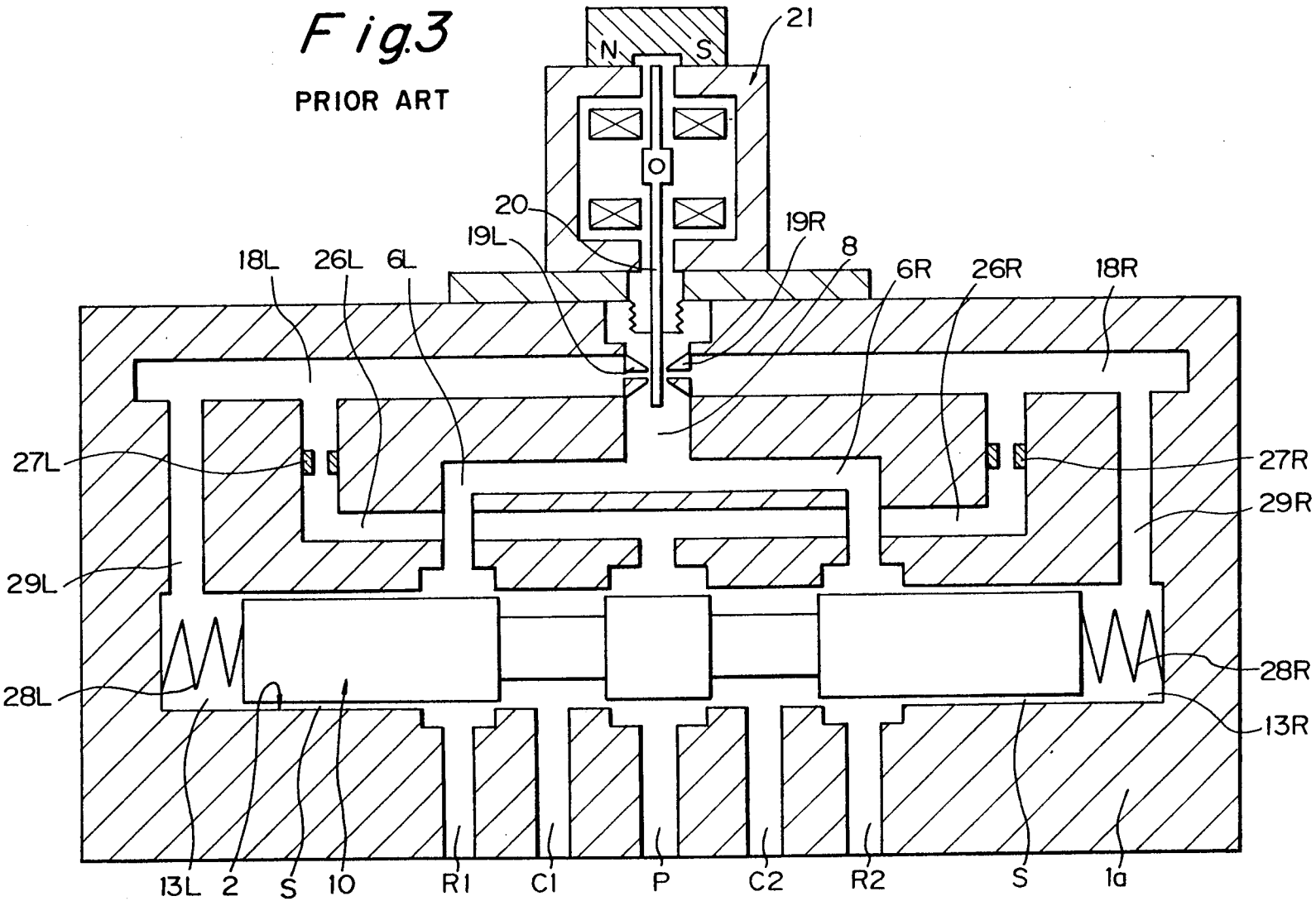
Fig.3 PRIOR ART
FIG. 3 is a sectional view which schematically illustrates another conventional hydraulic servo-valve.

For the purpose of simplification, description will be made below only with regard to the right-hand side of the spool 10. Pressurized hydraulic liquid is introduced into the interior of the hydraulic servo-valve via a pump port P and flows through a sleeve port 3, a passage 17, orifices 16R, an annular pocket 15, an annular clearance C, the pilot chamber 13R, the passage 29 and the nozzle back-pressure chamber 18R to reach the nozzle 19R. Then, the hydraulic liquid flows through the gap between the nozzle 19R and the flapper 20, a central chamber 8, a passage 6R, a sleeve port 4R and a tank port R2 to return to the tank. At this time, a quantity of the hydraulic liquid returning directly to the tank via the pocket 15R, the clearance C, the sleeve port 4R and the tank port R2 is lost. However, the quantity of leaked hydraulic liquid, i.e., distribution of the hydraulic liquid in the pocket 15R can be controlled by the size of the clearance C and a configuration of the pocket 15R. In addition, back-pressure in the nozzle back-pressure chamber 18R can be controlled by the orifices 16R and the clearance C in the same manner as the orifice 27 which has been described above with reference to FIG. 3.

With the hydraulic servo-valve as constructed in the above-described manner, when the flapper 20 is displaced, e.g., in the leftward direction in response to the input of an electrical signal into the torque motor 21, pressure in the nozzle back-pressure chamber 18L is increased but pressure in the nozzle back-pressure chamber 18R is reduced. Thus, pressure in the pilot chamber 13L is increased but pressure in the pilot chamber 13R is reduced. As a result, the spool 10 is displaced in the rightward direction against the resilient force of the spring 28R. Therefore, pressurized hydraulic liquid delivered from a pump port P is introduced into the interior of a hydraulic cylinder (not shown) via a sleeve port 3 and a cylinder port C1. On the other hand, the hydraulic liquid returning from the hydraulic cylinder is delivered back to a tank (not shown) via cylinder port C2, a sleeve port 4R and a tank port R2. In a case where the flapper 20 is displaced in the rightward direction, the spool 10 is displaced in the leftward direction. Thus, the hydraulic servo-valve operates in a reverse manner to the foregoing case.

Figure 7:
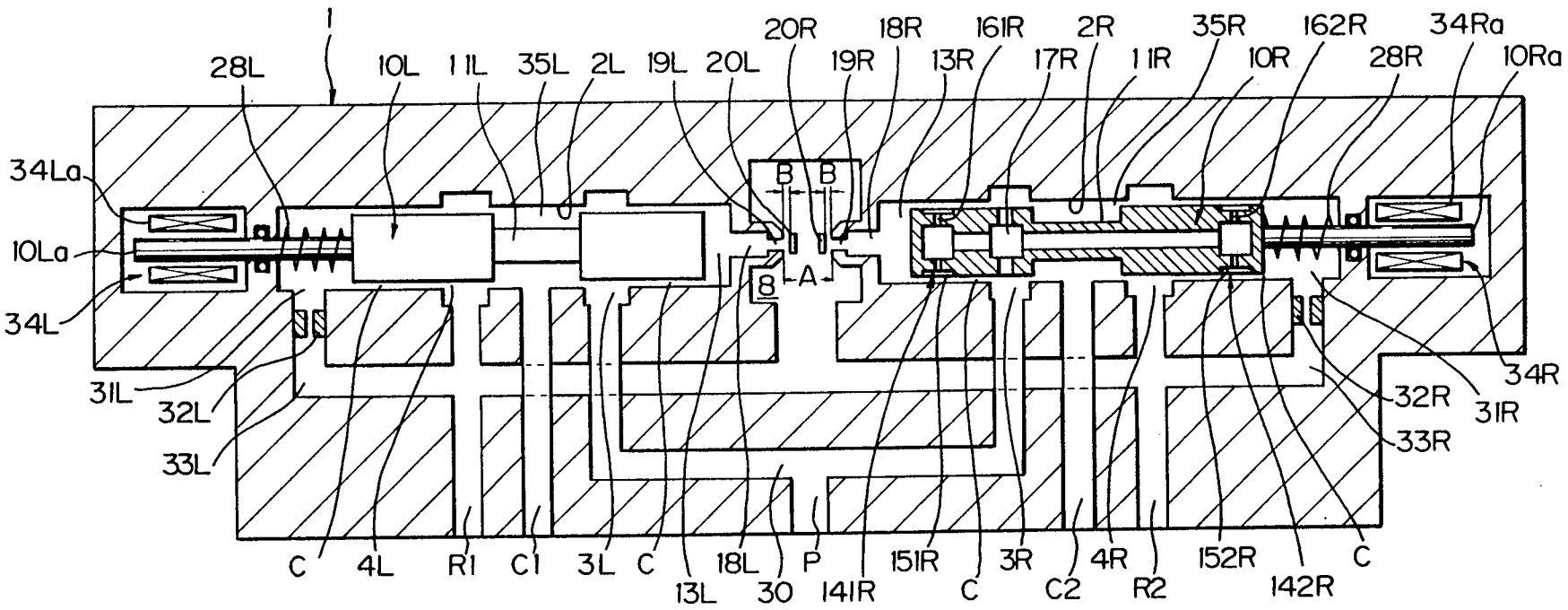

FIG. 7 shows a further embodiment of the present invention.

Referring to FIG. 7, the hydraulic servo-valve includes a valve body 1 in which an opposing pair of sleeves 2L and 2R, an opposing pair of nozzle back-pressure chambers 18L and 18R and an opposing pair of nozzles 19L, 19R are arranged in alignment with each other in a horizontal direction as shown in the drawing. Spools 10L and 10R are slidably received in the sleeves 2L and 2R. The nozzles 19L and 19R are protruded in the interior of a central chamber 8 of the valve body 1, while a gap A is formed between the nozzles 19L and 19R. In addition, flappers 20L and 20R operatively associated with torque motors (not shown) firmly mounted on a valve body 1 are inserted into the gap A with a slight amount of gap B being kept between the nozzles 19L and 19R and the flappers 20L and 20R. The sleeve 2L is formed with a sleeve port 3L and a sleeve port 4L, while the sleeve 2R is formed with a sleeve port 3R and a sleeve port 4R. The sleeve ports 3L and 3R communicate with a pump port P via a passage 30 and the sleeve ports 4L and 4R communicate with tank ports R1 and R2.

A spring chamber 31L is formed between the valve body 1 and the spool 10L on the side opposite to the nozzle 19L of the sleeve 2L and a spring 31L is received in the spring chamber 28L, while a spring chamber 31R is formed between the valve body 1 and the spool 10R on the side opposite to the nozzle 19R of the sleeve 2R and a spring 28R is received in the spring chamber 31R. The spring chamber 31L communicates with a tank port R1 and the central chamber 8 via a passage 33L including an orifice 32L, while the spring chamber 31R communicates with a tank port R2 and the central chamber 8 via a passage 33L including an orifice 32R.

An annular clearance C is formed between the spool 10L and the sleeve 2L as well as between the spool 10R and the sleeve 2R. In addition, a smaller diameter portion 11L having a length appreciably shorter than the distance between a sleeve port 3L and a sleeve port 4L is formed at the intermediate part of the spool 10L, while a smaller diameter portion 11R having a length appreciably shorter than the distance between a sleeve port 3R and a sleeve port 4R is formed at the intermediate part of the spool 10R. A chamber 35L formed between the smaller diameter portion 11L and the sleeve 2L communicates with a cylinder port C1 leading to a cylinder (not shown), while a chamber 35R formed between the smaller diameter portion 11R and the sleeve 2R communicates with a cylinder port C2 leading to a cylinder (not shown). Further, a static pressure bearing 141L and a static pressure bearing 142L are formed at opposite ends of the spool 10, while a static pressure bearing 141R and a static hydraulic bearing 142R are formed at opposite ends of the spool 10R. It should be noted that only the static pressure bearings 141R and 142R are shown in FIG. 7 for the purpose of simplification of illustration. Description will be made hereinafter only as to the spool 10R side for the purpose of simplification. Specifically, the static pressure bearing 141R includes a pocket 151R and orifices 161R, while the static pressure bearing 142R includes a pocket 152R and orifices 162R, and both the static pressure bearings 141R and 142R communicate with a sleeve port 3R via a passage 17R. More specifically, a pump port P communicates with the nozzle back-pressure chamber 18R via a passage 30, the sleeve port 3R, the passage 17R, the static pressure bearing 141R, the clearance C and the pilot chamber 13R. Further, the pump port P communicates with the spring chamber 31R via the passage 7R, the static pressure bearing 142R and the clearance C.

The spool 10L is provided with a displacement rod 10L*a* at the outer end thereof, while the spool 10R is provided with a displacement rod 10R*a* at the outer end thereof. The displacement rod 10L*a* is inserted into a coil 34L*a* of a displacement meter 34L provided in the valve body 1, while the displacement rod 10R*a* is inserted into a coil 34R*a* of a displacement meter 34R provided in the valve body 1. The displacement meters 34L and 34R and a torque motor are electrically connected to a microcomputer (not shown). With this construction, it becomes possible to control e.g., a one-sided rod type cylinder with the same degree of accuracy in both directions.

Next, operation of this embodiment will be described below.

For the purpose of simplification, description will be made only with regard to the spool 10R on the right-hand side. Pressurized hydraulic liquid is introduced into the interior of the hydraulic servo-valve via a pump port P and then flows through a passage 30 and a sleeve port 3R to reach a passage 17R at which the flow of hydraulic liquid is divided into two parts, one of which flows in the leftward direction and the other flowing in the rightward direction. The hydraulic liquid flowing in the leftward direction flows through orifices 161R, a pocket 151R, an annular clearance C, a pilot chamber 13R and a nozzle back-pressure chamber 18R to reach a nozzle 19R. Then, the hydraulic liquid flows through gap between the nozzle 19R and a flapper 20R and to a tank port R2 via a central chamber 8 and a passage 33R to return to a tank (not shown). On the other hand, the hydraulic liquid flowing from the passage 17R in the rightward direction flows through orifices 162R, a pocket 152R, an annular clearance C, a spring chamber 31R, an orifice 32R and the passage 33R to reach a tank port R2 from which the hydraulic liquid returns to the tank. A quantity of the hydraulic liquid which returns directly to the tank via the orifice 32R is lost but a ratio of a flow rate of the hydraulic liquid flowing in the leftward or rightward direction can be adjusted depending on the throttle effect provided by the orifices 161R and 162R in static pressure bearings 141R and 142R, the area of each of the pockets 151R and 152R and the size of the clearance C. In this manner, the spool 10R can be supported without contact of the spool 10R with the sleeve 2R.

With the hydraulic servo-valve constructed as described above, when e.g., the flapper 20R is displaced in the leftward direction in response to the input of an electrical signal into the torque motor, pressure in the nozzle back-pressure chamber 18R is reduced. As a result, pressure in the pilot chamber 13R is reduced, whereby the spool 10R is displaced in the leftward direction under the effect of the resilient force of a spring 28R. A quantity of displacement of the spool 10R in the leftward direction is detected by the displacement meter 34R via the displacement rod 10R*a* and the detected quantity of displacement is inputted into the microcomputer. As a spool 10R is displaced in the leftward direction, the hydraulic liquid coming from the pump port P is introduced into the hydraulic cylinder via the passage 30, the sleeve port 3R, the chamber 35R and a cylinder port C2. On the other hand, the present position assumed by the spool 10L is detected by the displacement meter 34L and data on the present position is inputted into the microcomputer. The microcomputer compares a value derived from the detection of the displacement meter 34L with a value derived from the detection of the displacement meter 34R. For example, a signal is outputted from the microcomputer to the torque motor such that a difference between two values derived from the detection of the displacement meters 34L and 34R becomes zero. Then, the torque motor is activated in response to the foregoing signal to displace the flapper 20L in the leftward direction. Consequently, pressure in the nozzle back-pressure chamber 18L and pressure in the pilot chamber 13L are increased, whereby the spool 10L is displaced in the leftward direction against resilient force of a spring 28L. As the spool 10L is displaced in the leftward direction, the hydraulic liquid returning from the hydraulic cylinder is delivered back to the tank via a cylinder port C1, a chamber 35L, a sleeve port 4L and a tank port R1. In a case where the flapper 20L is displaced in the rightward direction, the hydraulic servo-valve is operated in the reverse manner to the foregoing case so that the spool 10L is displaced in the rightward direction under the effect of the resilient force of the spring 28L.

In this manner, values derived from the detection of the displacement meters 34L and 34R are inputted into the microcomputer which in turn outputs a signal based on a difference between the both values thereby to change characteristics of both flapper mechanisms as required. According to the fourth embodiment of the present invention, the spools are separated from the flapper mechanisms so as to enlarge the range set for positional displacement of the spools thereby to increase a flow rate of the hydraulic liquid with reduced leakage of the hydraulic liquid. Consequently, the responsiveness of the flapper mechanisms can be improved. Additionally, the microcomputer can alter the characteristics of both the flapper mechanisms in such a manner as to control the cylinder at two speeds and control displacement of the one-side rod type cylinder with a high degree of accuracy.

Figure 8:
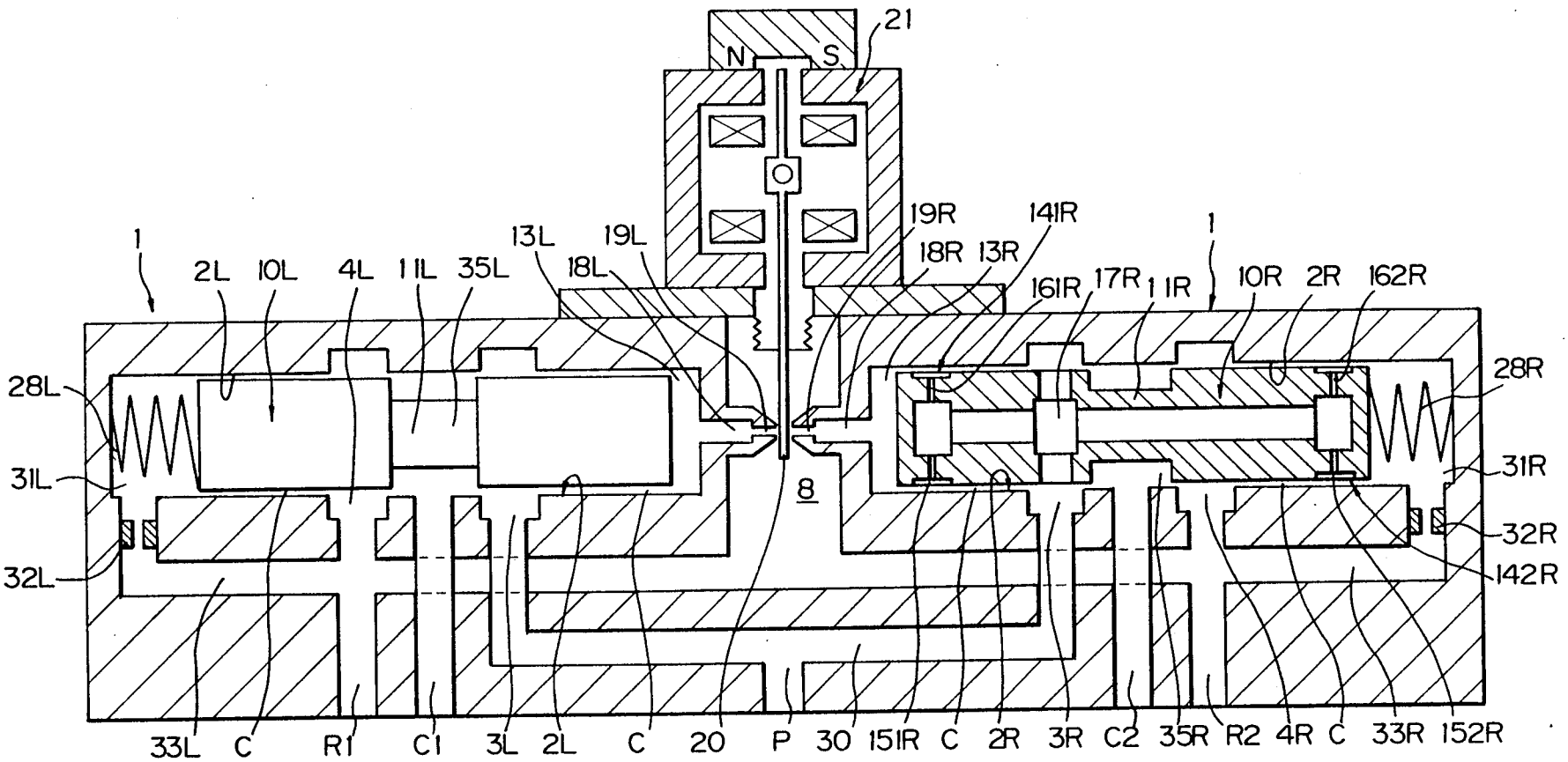

FIG. 8 shows a further embodiment of the present invention. In this embodiment, the hydraulic servo-valve includes a single flapper, an opposing pair of nozzles and an opposing pair of spools arranged on both sides of the flapper. Specifically, the hydraulic servo-valve includes a valve body 1 in which sleeves 2L and 2R, nozzle back-pressure chambers 18L and 18R and nozzles 19L and 19R are formed in alignment with each other in a horizontally extending common plane. Spools 10L and 10R are received in the sleeves 2L and 2R. The nozzles 19L and 19R protrude into the interior of a central chamber 8 which is formed in the valve body 1, and a flapper 20 adapted to be actuated by a torque motor 21 is inserted into a gap between the both nozzles 19L and 19R. The torque motor 21 is firmly mounted on the valve body 1. Other components rather than the aforementioned ones are the same as the components in accordance with the fourth embodiment which has been described above with reference to FIG. 7. Thus, no further description is included therein.

With the hydraulic servo-valve as constructed in the above-described manner, when the flapper 20 is displaced, e.g., in the leftward direction in response to input of an electrical signal into the torque motor 21, pressure in the nozzle back-pressure chamber 18L is increased but pressure in the nozzle back-pressure chamber 18R is reduced, whereby pressure in a pilot chamber 13L is increased but pressure in a pilot chamber 13R is reduced. Thus, the spool 10L is displaced in a leftward direction against the resilient force of a spring 28L, while the spool 10R is displaced in a leftward direction under the effect of the resilient force of a spring 28R. Consequently, hydraulic liquid coming from a pump port P is introduced into the interior of a hydraulic cylinder (not shown) via a passage 30, a sleeve port 3R, a chamber 35R and a cylinder port C2. On the other hand, the hydraulic liquid returning from the hydraulic cylinder is delivered back to a tank (not shown) via a cylinder port C1, a chamber 35, a sleeve port 4L and a tank port R1. In a case where the flapper 20 is displaced in the rightward direction, the hydraulic servo-valve operates in the reverse manner to the aforementioned case. Since operation of the hydraulic servo-valve is performed merely by positional displacement of the signal flapper 20 in the leftward direction or in the rightward direction, the hydraulic cylinder can be adjusted very simply.

It should, of course, be understood that hydraulic liquid to be used for the hydraulic servo-valve of the present invention should not be limited only to water but another hydraulic liquid, e.g., hydraulic oil may be used.

INDUSTRIAL APPLICABILITY

As will be apparent from the above description, according to the present invention, a part of the hydraulic liquid which has leaked from the conventional hydraulic servo-valve is positively utilized to form static pressure bearing(s) in order to support spool(s) in a contact free position with regard to the sleeve(s). With such a construction, the spool(s) and sleeve(s) are not subject to wear. In addition, the degree of machining accuracy required for said parts can be reduced. Thus, spool(s) and the sleeve(s) can be made of a stainless material, e.g., plastics and water can be used as a working liquid. Further, since the hydraulic servo-valve of the present invention is not subject to problems of, e.g., wear, rusting and leakage, it can be widely used in many industrial fields for the purpose of controlling or remote controlling various kinds of industrial machines.

We claim:

1. A hydraulic servo-valve comprising:

a spool adapted to slidably move in a valve body to change a direction of flowing of a working liquid and vary a flow rate of said working liquid;

nozzle back-pressure chambers to which a pilot pressure is applied to displace said spool;

a flapper mechanism including a nozzle and a flapper;

static pressure bearings formed at opposite ends of said spool, each of said static pressure bearings including a plurality of orifices and a pocket; and a passage is formed inside said spool and connected to said static pressure bearings and to a pump port so as to allow the working liquid to flow from said pump port through said orifices and pocket of said static pressure bearing to said nozzle back-pressure chamber.

2. A hydraulic servo-valve as claimed in claim 1, wherein two sets of nozzles and nozzle back-pressure chambers are provided in the valve body, said nozzles and said nozzle back-pressure chambers being located on both sides of the spool in alignment with the spool.

3. A hydraulic servo-valve as claimed in claim 2, wherein said hydraulic servo-valve is provided with two flappers each of which is turnably supported at the substantially intermediate location thereof, one end of each of said flappers being located near to said two nozzles, while another end of each of said flappers is pivotally supported by a single movable shaft.

4. A hydraulic servo-valve as claimed in claim 1, wherein an opposing pair of nozzles and an opposing pair of nozzle back-pressure chambers are arranged integrally with said spools at side ends of the latter and said hydraulic servo-valve is provided with two flappers each of which is turnably supported at the substantially intermediate location thereof, one end of each of said flappers being located near to said two nozzles, while another end of each of said flappers is pivotally supported by a single movable shaft.

5. A hydraulic servo-valve as claimed in claim 1, said hydraulic servo-valve is provided with two spools which are arranged in alignment with each other, said hydraulic servo-valve is provided with two nozzle back-pressure chambers and two nozzles in the valve body on the side opposite to said spools and said hydraulic servo-valve is provided with two flappers adapted to open or close said nozzles.

6. A hydraulic servo-valve as claimed in claim 5, each of said two spools is provided with a displacement meter and said hydraulic servo-valve is provided with a controlling means for controlling positional displacement of one spool corresponding to positional displacement of an other spool in response to a detection signal derived from said displacement meters.

7. A hydraulic servo-valve as claimed in claim 1, said hydraulic servo-valve is provided with two spools which are arranged in alignment with each other, said hydraulic servo-valve is provided with two nozzle back-pressure chambers and two nozzles on the opposite sides to said spools and said hydraulic servo-valve is provided with a single flapper for opening or closing said two nozzles.

* * * * *